United States Patent [19]

Lumpert et al.

[11] 3,995,417

[45] Dec. 7, 1976

[54] PROCESS AND APPARATUS FOR COUNTING YARN BREAKAGES

[75] Inventors: Jurg B. Lumpert, Zollikerberg; Edouard G. Ammann, Baretswil, both of Switzerland

[73] Assignee: Palitex Project-Company G.m.b.H., Krefeld, Germany

[22] Filed: July 11, 1975

[21] Appl. No.: 595,006

[30] Foreign Application Priority Data

July 15, 1974 Switzerland ..... 9700/74

[52] U.S. Cl. ..... 57/34 R; 57/81; 57/156; 340/259

[51] Int. Cl.[2] ..... D01H 13/32

[58] Field of Search ..... 57/34 R, 80, 81, 156, 57/157 R; 235/92 R; 340/259

[56] References Cited

UNITED STATES PATENTS

| | | | |
|---|---|---|---|
| 3,114,233 | 12/1963 | Guri | 57/81 |
| 3,158,852 | 11/1964 | Schacher | 57/81 X |
| 3,430,426 | 3/1969 | Bryan, Jr. et al. | 57/34 R |
| 3,523,415 | 8/1970 | Suzuki | 57/81 |
| 3,660,972 | 5/1972 | Neill et al. | 57/34 R |
| 3,673,591 | 6/1972 | Schwartz | 340/259 |
| 3,680,298 | 8/1972 | Saunders | 57/34 R |
| 3,680,299 | 8/1972 | Lee, Jr. | 57/34 R |
| 3,772,524 | 11/1973 | Erbstein | 340/259 X |

*Primary Examiner*—John Petrakes
*Attorney, Agent, or Firm*—Larson, Taylor and Hinds

[57] ABSTRACT

An electrical process and device are described wherein interruptions in the passage of yarn from a series of supply bobbins, used in succession, to a wind-up bobbin are detected by a yarn breakage surveying device that transmits an impulse for each interruption. Some of these interruptions are due to supply bobbin changing and others to yarn breakages. Only the interruptions due to breakages are transmitted to a counter by way of a gate that receives the said impulses as well as periodic signals from a timing device. The timing device is actuated for spaced periods initiated by signals from a differentiating circuit for each change from "no yarn" to "yarn present" indicated by the surveying device, the latter being connected to the differentiating circuit as well as directly to the timing circuit. Each timing circuit period is limited to a total which is less than the average period required for each supply bobbin to unwind, but for each yarn breakage a gap appears in an associated one of the periods, the gate transmitting an impulse to the counter only when such a gap arises.

7 Claims, 2 Drawing Figures

PROCESS AND APPARATUS FOR COUNTING YARN BREAKAGES

FIELD OF THE INVENTION

The present invention relates to a process for counting yarn breakages in textile machines with supply bobbins from each of which at least one yarn is removed and supplied to a wind-up bobbin provided downstream of the supply bobbin, the presence of yarn between the supply bobbins and the wind-up bobbin being surveyed and an electrical signal produced. The invention further relates to apparatus for effecting this process.

DESCRIPTION OF THE PRIOR ART

It is known to use yarn breakage surveying devices in textile machines. These are for example used in the spinning or plytwisting stations to ascertain if one or several yarns pass therethrough correctly. If the passage of yarn is interrupted for some reason or other, this is indicated by the surveying device. As surveying devices, for example, electrical or optical devices can be used. These surveying devices produce a signal which is fed to a counter. Interruptions in the passage of the yarn or yarns may occur if the yarn gets broken or if the supply bobbins from which the material comes are exhausted. With the known devices, it is not possible to distinguish if the interruption of yarn movement is due to yarn breakage or to an exhausteed supply bobbin.

SUMMARY OF THE INVENTION

It is the purpose of the present invention to provide a process and a device by means of which counting of real yarn breakages, while eliminating other reasons for interruption, is possible. Particularly, interruptions in the passage of yarn because of exhausted supply bobbins are not counted.

According to the present invention, this problem is resolved by converting the signals from the yarn surveying device into impulses in a differentiating circuit, the impulses triggering a timing circuit the running of which is interrupted if a signal is fed to the timing circuit directly from the yarn surveying circuit, the signals of the yarn surveying device and of the timing circuit being compared with each other and, in the presence of both signals an impulse is produced which is registered by the counter.

The present invention can be realized by a counter which consists of a yarn breakage surveying device, a differentiating circuit, a timing circuit, a gate and a counter, a conductor for the transmission of electrical signals being provided between the yarn breakage surveying device on one hand and the differentiating circuit, the timing circuit and the gate, taken individually, on the other hand.

When using this solution, it is possible to register the number of real yarn breakages separately from the other interruptions in the passage of yarn. As soon as the number of real yarn breakages per processing station or per machine can be determined, it is also possible to give exact indications of the quality of processing, of the processing station or the whole machine. Possible accumulations of yarn breakages can be registered clearly, and the necessary measures taken or necesary repairs effected. It is furthermore possible to survey the performances and the quality of the work done by the personnel and, depending on the data obtained, to use the personnel accordingly. In practice, it has proved that the evaluation of the data and the use of the knowledge obtained makes possible an increase of performance of between 4 and 5 percent per machine.

The present invention can in principle be used on all textile machines having a yarn breakage surveying device. The use however only makes sense if, besides yarn breakages, also other circumstances may prevent passage of the yarn. This is particularly often the case if such counting devices are used on ply-twisting machines. In machines of this type, at least one yarn passes from a supply bobbin to a wind-up bobbin, for example a cross-wound bobbin, via thread-guides and a ply-twisting device. Between the ply-twisting device and the wind-up bobbin, the presence of yarn is checked. A ply-twisting machine may comprise up to 130 and more such locations of yarn passage.

It has proved particularly advantageous if the duration of the period of the time circuit is adjusted to a value of between 50 and 100 percent of the average unwinding or winding-off time of the supply bobbins. If a signal is fed to the timing circuit which indicates interruption of yarn movement directly from the yarn breakage surveying device, the operation of the time circuit is interrupted.

It is furthermore advantageous to provide, for each yarn path, one yarn breakage surveying device, one differentiating circuit, one timing circuit and gate and to provide one counter for all the yarn paths.

Exact counting results are obtained if the maximum deviations of the winding-off time of the supply bobbins is within a range of +/− 25 percent of the average winding-off time.

DESCRIPTION OF THE DRAWINGS

Further details of the present invention will be explained hereinafter with reference to the accompanying drawings which show one example of the invention and in which:

FIG. 1 shows schematically the ply-twisting station of a double twist ply-twisting machine. At least one yarn 8 is wound off from a supply bobbin 1. This passes through a guiding and ply-twisting device 3 and over a guide roller 4 to a wind-up bobbin 5. The full wind-up bobbins always contain the yarn of a plurality of supply bobbins 1. Between the guiding device 3 and the guide roller 4, there is provided a yarn sensor 10 which detects the passage or non-passage of yarn. In the present example, the yarn sensor 10 consists of a mechanical sensor. Surveying the passage of the yarn may however also be effected by other known means for example optical sensing or by electromagnetic means.

Figure 1:
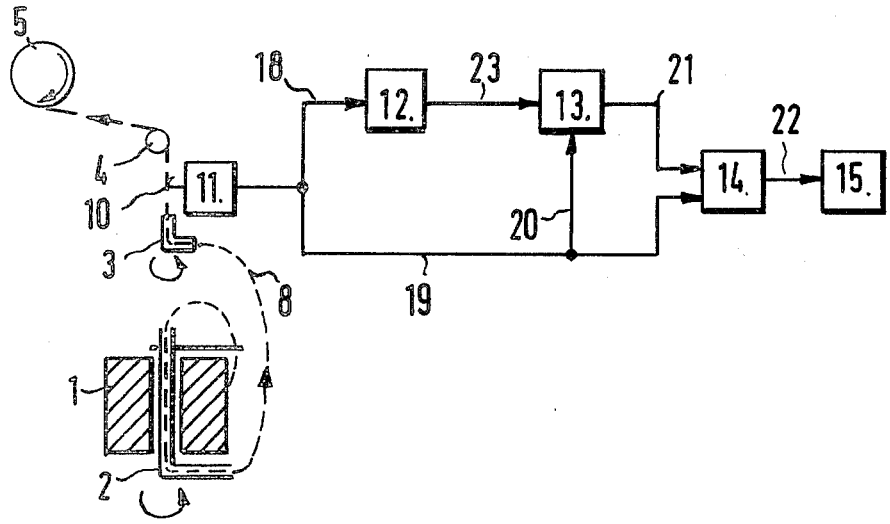
FIG. 1 shows schematically a ply-twisting machine with a block circuit diagram of a counting device.

The values measured by the yarn sensor 10 are converted by a yarn breakage surveying device 11 into signals which are fed to a differentiating circuit through a conductor 18. At the same time, the signals are also fed to a timing circuit 13 and to a gate 14 through conductors 19 and 20. In the differentiating circuit 12, the signals from the yarn breakage surveying device 11 are processed so that, if the signal changes from "no-yarn" to "yarn-present" an impulse is produced which is fed to the timing circuit 13 through conductor 23 and starts the timing circuit. The timing circuit itself now furnishes a signal the length of which is 75 percent of the average unwinding time of the supply bobbins. The timing circuit 13 is disposed so that signals from the differentiating circuit 12 do not influence it as long as it is running. At the same time, as already stated, the signal from the yarn surveying device 11 is fed directly to the timing circuit 13 through conductor 20. This signal influences the timing circuit 13 so that its time does not continue to run if there is no yarn or if the yarn is not in movement. By means of this circuit, it is assured that the signal from the timing circuit 13 always ends as soon as three quarters of the average unwinding time of the bobbins has taken place.

This is also the case if there have been one or several standstills of the bobbin. The time impulse from the timing circuit 13 is now compared in gate 14 with the yarn sensor signal. The output conductor 22 of gate 14 always yields an impulse if, on one hand, a signal from the timing circuit 13 is present and on the other hand the signal from the yarn breakage surveying device 11 corresponds to the absence of yarn.

The impulses of gate 14 are fed to a counter 15 through conductor 22. This counter adds all yarn breakage signals. The counter may be for the whole machine, or there may be counters allocated respectively to each of the yarn passage stations in the machine.

Figure 2:
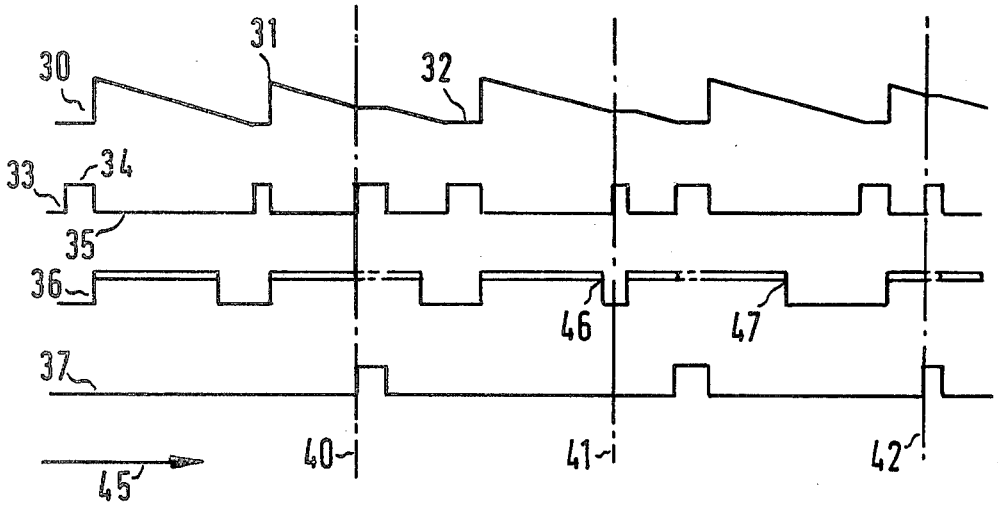
FIG. 2 is a diagram of signals and impulses produced by individual parts of the counting device.

The operation of the counting device will now be explained in more detail with reference to FIG. 2. The saw-tooth curve of FIG. 2 shows the winding-off of yarn from supply bobbins 1. The uppermost peak of each tooth represents a full bobbin. In the lowermost portion 32 of each tooth, the supply bobbin 1 is empty and is being replaced. All curves of FIG. 2 are shown over a time axis 45 which extends from the left to the right. The curve 33 shows the signals of the yarn breakage surveying device 11, the lowermost level 35 of the signal showing the condition in which the yarn passes normally. If a thread breakage occurs or if there is no passing yarn because of change of the supply bobbin 1, the signal 33 changes over to level 34. The opposite is the case if the yarn starts to run. This signal change is registered in the differentiating circuit 12 and produces an impulse which triggers time circuit 13. The signals of time circuit 13 are shown as curve 36. The curve 37 shows the output impulses of gate 14.

Vertically through FIG. 2, dash-dot lines 40, 41 and 42 are shown which represent real yarn breakages. This can also be recognized from curve 30 since each respective supply bobbin 1 is no longer being wound off. In the course of unwinding the second supply bobbin 1, i.e., in the second sawtooth, a yarn breakage 40 occurs. This coincides with the impulse from the timing circuit 13, and a counting impulse is accordingly produced in gate 14 which is fed to counter 15. During winding off of the third supply bobbin 1, i.e., in the third sawtooth, again a yarn breakage 41 occurs but only after the timing circuit has stopped. The end of the running time of the time circuit is marked by point 46. Since, therefore, only one signal is present in gate 14, no counting impulse is produced. On the other hand, the timing circuit is again started by an impulse from the device 11. As a compensation, the end of unwinding the third bobbin is now registered as yarn breakage. The time of timing circuit 13 is also interrupted and only continues to run when the fourth bobbin starts to be unwound. The period of timing circuit 13 then again ends at point 47. This timing circuit only starts to run again if an impulse is delivered by differentiating circuit 12 because of yarn breakage or of bobbin changing.

Exact counting results and the correct differentiation between standstills due to yarn breakage or to the changing of supply bobbin 1 are possible if the unwinding time of the supply bobbins only differs from the average winding off time within a determined range. The maximum difference should not exceed +/− 25 percent of the average unwinding time.

The invention has been described on a double-twist ply-twisting machine. Its use is however not limited to these machines, but its use may rather be extended to any situation where the passage of at least one yarn must be surveyed and a distinction made between yarn breakages and interruptions of yarn passage due to the changing of supply bobbins.

We claim:

1. A process for counting yarn breakages in textile machines of the type wherein at least one yarn drawn in succession from a series of supply bobbins is supplied to a subsequent processing station, the process comprising the steps of sensing the passage of yarn from said supply bobbins to said station, signalling interruptions due to supply bobbin changing and to yarn breakages, as determined by said sensing step, as impulses simultaneously to a differentiating circuit and to a gate, generating in said differentiating circuit signals caterminous with the initiation of each passage of yarn from said bobbins subsequent to an interruption, actuating a timing circuit by said signals for spaced periods respectively initiated by each said signal and allocated respectively to said bobbins, the total length of each said period being limited by said timing circuit and in the absence of interruptions due to yarn breakages being less than the average period required for each said bobbin to unwind, applying signals corresponding to said periods to said gate, whereby said gate passes pulse signals corresponding only to timing circuits periods wherein yarn breakages are registered, and counting said pulse signals passed by said gate.

2. A process according to claim 1, in which said impulses due to yarn interruptions are signalled to said timing circuit, simultaneously to the signalling of said impulses to said differentiating circuit and to said gate, to inhibit the actuation of said timing circuit in the absence of yarn and when there is no yarn movement.

3. A process according to claim 1, in which each of said spaced periods amounts to a percentage between 50 and 100 percent inclusive of the average unwinding time of each supply bobbin.

4. A process according to claim 1, in which any one of said impulses that is due to yarn breakage effects the interruption of an associated one of said timing circuit periods.

5. In a textile machine of the type comprising supply bobbin mounting means and a processing station for receiving at least one yarn withdrawn from similar supply bobbins mounted in succession on said mounting means, the improvement comprising the combination of a yarn breakage surveying device for detecting interruptions, due to supply bobbin changing and to yarn breakages, of yarn passing from said supply bobbins to said processing station and generating a series of impulses determined respectively by said interruptions, a differentiating circuit, a timing circuit, a gate, connecting conductors for simultaneous transmission of said impulses to said differentiating circuit, said timing circuit and said gate, a connecting conductor for transmission of signals from said differentiating circuit to said timing circuit and a transmission conductor for transmission of timing signals from said timing circuit to said gate, said differentiating circuit being controlled by said impulses to transmit to said timing circuit signals synchronous with the initiation of each passage of yarn detected by said breakage surveying device, said timing circuit being actuated by said signals respectively for spaced periods, said periods being limited by said timing circuit and less than the average period required for each said bobbin to unwind, and said timing circuit applying signals corresponding to said periods to said gate, whereby said gate passes pulse signals corresponding only to gaps in said periods due to yarn breakages, and a counter for counting said pulse signals.

6. In a textile machine, the combination according to claim 5, arranged for the maximum deviation between the unwinding times of said supply bobbins to lie within the range of plus 25 to minus 25 percent inclusive of the average unwinding time.

7. In a textile machine according to claim 5, a plurality of supply bobbin mounting means and a corresponding plurality of processing stations for respectively receiving yarns from supply bobbins mounted on said plurality of mounting means, and a plurality of said combinations, each said combination including a yarn breakage surveying device, a differentiating circuit, a timing circuit and a gate, and a single counter common to the plurality of combinations.

* * * * *